US009032899B1

(12) United States Patent
Hoffman et al.

(10) Patent No.: US 9,032,899 B1
(45) Date of Patent: May 19, 2015

(54) IMPLOSION MITIGATION METHOD

(71) Applicant: The United States of America as represented by the Secretary of the Navy, Washington, DC (US)

(72) Inventors: Mark W. Hoffman, Manassas, VA (US); Robert Kent Tacey, Alexandria, VA (US); Erwin Thomas Moyer, Jr., Poolesville, MD (US); Jason S. Craft, Gaithersburg, MD (US); Ronald S. Barbaro, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 196 days.

(21) Appl. No.: 13/658,265

(22) Filed: Oct. 23, 2012

Related U.S. Application Data

(62) Division of application No. 12/423,390, filed on Apr. 14, 2009, now Pat. No. 8,322,295.

(51) Int. Cl.
*B63G 8/00* (2006.01)
*B63B 3/13* (2006.01)
*B63B 43/00* (2006.01)

(52) U.S. Cl.
CPC . *B63B 3/13* (2013.01); *B63B 43/00* (2013.01); *B63G 8/001* (2013.01)

(58) Field of Classification Search
CPC ..... B63B 3/13; B63B 3/02; B63B 3/04; B63B 3/08; B63B 2003/145; B63B 43/00; B63G 8/00; B63G 8/001
USPC ..... 114/330, 333, 339, 341, 317, 312; 220/565, 585, 592, 669, 675, 62.22, 220/581, 62.11, 586, 89.1
See application file for complete search history.

(56) References Cited

U.S. PATENT DOCUMENTS

| | | | |
|---|---|---|---|
| 3,484,317 | A | 12/1969 | Dickerson |
| 3,611,966 | A | 10/1971 | Hunter |
| 3,704,678 | A | 12/1972 | Kelly |
| 4,192,384 | A | 3/1980 | Croy |
| 4,365,576 | A | 12/1982 | Cook |
| 4,402,632 | A | 9/1983 | Cook |
| 4,805,726 | A | 2/1989 | Taylor et al. |
| 5,654,053 | A | 8/1997 | Crane et al. |
| 7,117,813 | B2 | 10/2006 | Kellermann et al. |
| 7,354,495 | B2 | 4/2008 | Carter et al. |
| 7,707,957 | B1 | 5/2010 | Dudt et al. |
| 2007/0125289 | A1 | 6/2007 | Asfar et al. |

*Primary Examiner* — Anthony Stashick
*Assistant Examiner* — Ernesto Grano
(74) *Attorney, Agent, or Firm* — Dave A. Ghatt

(57) ABSTRACT

An arrangement and a method for implosion mitigation, and in particular a structural arrangement of a water vessel and a method thereof for mitigating implosion loads. The water vessel includes first and second end portions connected by a middle portion, with one portion structurally weaker than the others so that when the vessel experiences an overmatching load, only the structurally weaker portion of the vessel fails. The vessel may further include energy absorbing structures.

9 Claims, 5 Drawing Sheets

Method 300

IMPLOSION MITIGATION METHOD

RELATED APPLICATIONS

This is a division of U.S. patent application Ser. No. 12/423,390, filed Apr. 14, 2009, now U.S. Pat. No. 8,322,295, hereby incorporated by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to an arrangement and a method for implosion mitigation, and in particular a structural arrangement of a water vessel and a method thereof for mitigating implosion loads.

BACKGROUND

Underwater pressure vessels are designed to withstand the hydrostatic pressure exerted on the vessels by the surrounding water. Additional loads may include impact or underwater explosions. Any combination of loads that exceeds the design capability of the vessel may cause the vessel structure to fail. If a pressure vessel is not completely filled, then volumes exist that can collapse suddenly (implode). If an underwater vessel implodes in close proximity to other vessels such as submarines, adverse effects to systems or structures may occur.

When a pressure vessel implodes in water, a potentially significant pressure wave results. This wave has an initial underpressure phase that is followed by a shock-like overpressure phase. The underpressure results from the collapse of the structural boundary, exposing the internal volume (typically low air pressure inside the structure) to the ambient water pressure. The shock-like overpressure results from the collision of the surrounding water and structure against the vessel. As the structure collapses, the surrounding water builds momentum as it rushes inward during the collapse. When the air volume reaches a minimum, the velocity of the water is forcibly arrested and the water compresses, resulting in a shock wave that travels back out into the water. Damage to nearby vessels may result. The prior art does not teach underwater vessels that are designed to mitigate implosion loads.

SUMMARY

In one aspect, the invention is a vessel for implosion mitigation. In this aspect, the vessel has a first end portion and a second end portion. The vessel also has a middle portion connecting the first end portion to the second end portion. According to the invention one of the first end portion and the middle portion is structurally weaker than the other portions so that under an overmatching load, only one of the first end portion and the middle portion fails.

In another aspect, the invention is a method of implosion mitigation in an underwater environment at a depth at which the existing pressure load is an overmatching load. According to the invention, the overmatching load is a hydrostatic load, an impact load, an explosion load, or combinations thereof. The method includes the providing of a vessel and the controlling of the failure mode of the vessel. In this aspect, the failure mode is controlled by providing a predetermined fracture portion of the vessel, wherein only the predetermined fracture portion fails at the hydrostatic buckling pressure. Thus, allowing surrounding water into the vessel primarily via the predetermined fracture portion.

BRIEF DESCRIPTION OF THE DRAWINGS

Other features will be apparent from the description, the drawings, and the claims.

DETAILED DESCRIPTION

Figure 1A:
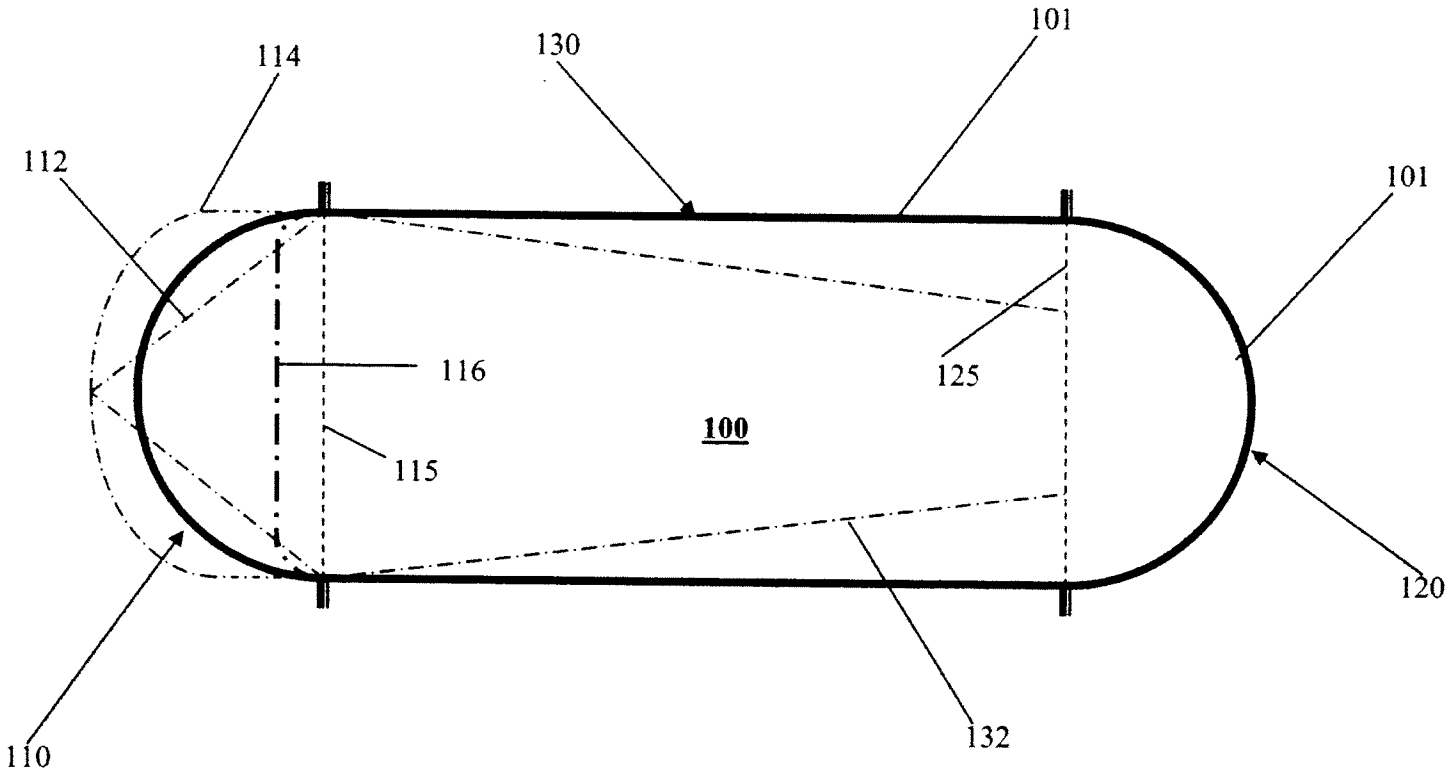
FIG. 1A is an exemplary schematic illustration of a vessel for mitigating an implosion load, according to an embodiment of the invention.

FIG. 1A is an exemplary schematic illustration of a vessel 100 for mitigating an implosion load, according to an embodiment of the invention. The vessel 100 may be any type of pressure vessel typically used in undersea environments, such as a submarine, an unmanned underwater vessel, an underwater storage canister, or the like. As shown in FIG. 1A, the vessel includes a vessel frame 101 having end portions 110 and 120, and a middle portion 130 connected to each of the end portions 110 and 120. FIG. 1A shows the portions separated by imaginary lines 115 and 125.

FIG. 1A shows the end portions 110 and 120 having dome shapes, and the middle portion 130 having a cylindrical shape. As stated above, the vessel 100 may be any type of vessel typically employed in undersea environments, and thus depending on the application, the vessel 100 may have a different shape. Thus, one or both end portions 110 and 120 may have a different shape. FIG. 1A shows examples of other possible shapes for end portion 110. Dotted-dashed lines 112, 114, and 116 represent, a conical, a toriconical, and a flat shape, respectively, at the end portion 110. Similar exemplary shapes may be employed at the other end portion 120. FIG. 1A also shows a possible frustroconical shape 132 for the middle portion 130. Therefore, in one exemplary embodiment, the vessel 100 may have a first end portion 110 that has a conical shape, a middle portion 130 that has a cylindrical shape, and a second end portion 120 that has a flat shape. It should be noted that portions 110, 120, and 130 may have shapes, other than those illustrated.

In situations in which the vessel 100 is submerged and experiences a failure by buckling or fracturing for example, the vessel 100 is designed to mitigate any resulting implosion load. Implosion load mitigation is achieved by controlling the failure mode of the vessel 100 in a manner that minimizes and dissipates the energy of the inflowing water and the resulting loads/shock waves after the vessel buckles. According to an embodiment of the invention, one of the end portions 110 and 120 is designed to fail before the other end portion and the middle portion 130. Thus for example, end portion 110 may be structurally weaker than end portion 120 and middle portion 130. According to this exemplary embodiment, when the vessel 100 experiences failure due to an overmatching load, end portion 110 buckles and ruptures, whereas portions 120 and 130 are able to withstand the overmatching load. Thus for example, when the end portion 110 is a stiffened dome as shown in FIG. 1 the end portion 110 may be designed to tear or invert. Or for example, when the end portion 110 is a cone, the end portion 110 may be designed to fail due to general instability, axisymmetric interframe buckling, asymmetric interframe buckling, multiwave buckling, or local frame instability, or combinations thereof.

Figure 1C:
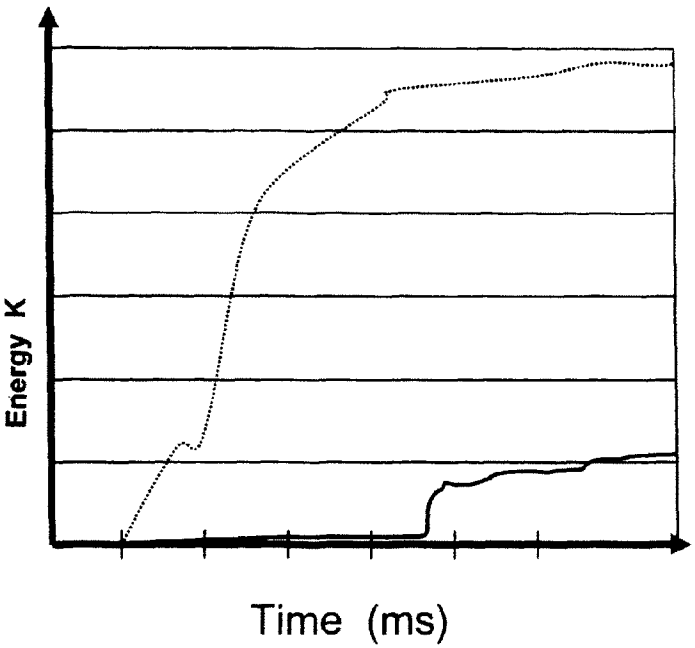
FIG. 1C is a graphical illustration comparing associated energy measurements for a dome-first collapsed vessel model to a cylinder-first collapsed model, during an implosion event.
Figure 1B:
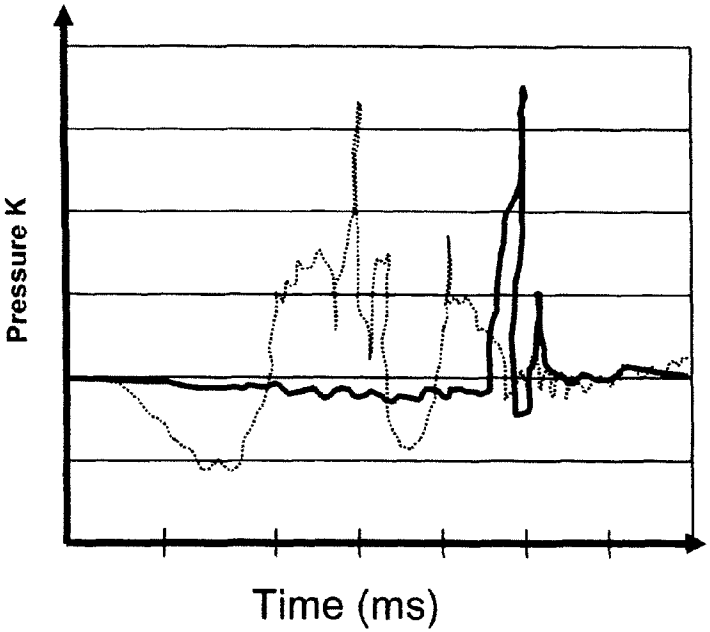
FIG. 1B is a graphical illustration comparing pressure measurements for a dome-first collapsed vessel model to a cylinder-first collapsed model, during an implosion event.

It should be noted that the vessel 100 may be structured so that the middle portion 130 fails first. When the middle portion 130 is a cylinder, failure may occur via an axisymmetric mode, asymmetric mode, multiwave mode, a general instability mode, or combinations of these modes. FIGS. 1B and 1C are graphical illustrations comparing pressure measurements and associated energy calculations for a dome-first collapsed vessel model to a cylinder-first collapsed vessel model. A dome-first collapsed vessel model may refer to a two-dome cylindrical vessel as illustrated in FIG. 1A, in which only one of the dome end portions 110 or 120 fails under a loading, as outlined above. A cylinder-first collapsed vessel model may refer to a two-dome cylindrical vessel as illustrated in FIG. 1A, in which only the cylindrical middle portion 130 is designed to fail under a loading. It should be noted that FIGS. 1B and 1C reflect measurements for a vessel 100 in which the dome portions 110 and 120 are hemispheres. During an implosion event, as shown in FIG. 1B, the surging pressure wave is reduced more efficiently by using a dome-first collapsed vessel as compared to the cylinder-first vessel. FIG. 1B shows the results for the dome-first vessel model as a solid line, and the results for the cylinder-first vessel model as a dotted line. FIG. 1C shows during an implosion event that the dome-first vessel model produces significantly less energy as compared to the cylinder-first vessel model. FIG. 1C shows the results for the dome-first vessel model as a solid line, and the results for the cylinder-first vessel model as a dotted line. Even though the dome-first vessel model appears to be more efficient, both designs may be used to mitigate an implosion load.

Figure 2A:
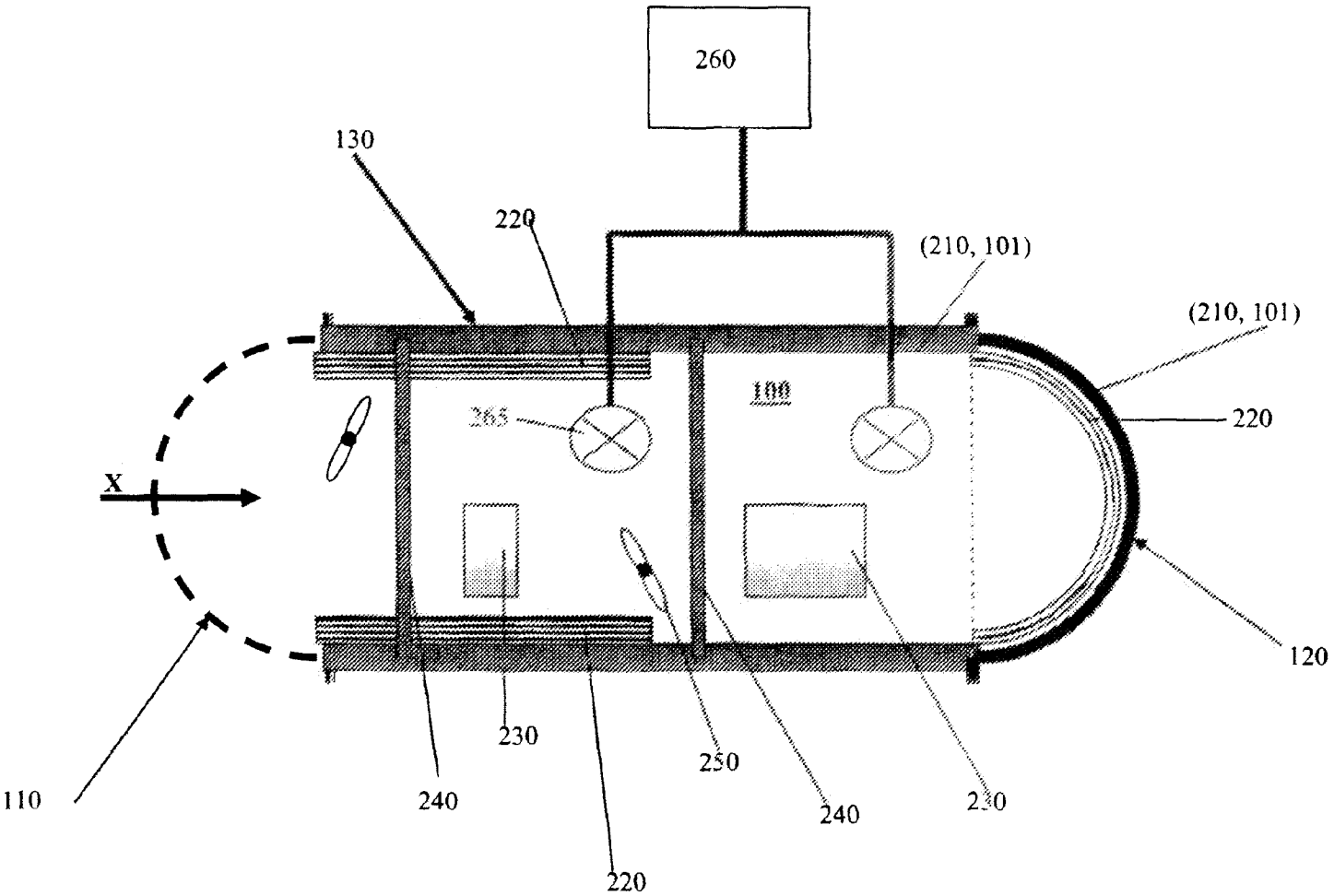
FIG. 2A is an exemplary schematic illustration of a vessel for mitigating an implosion load, according to an embodiment of the invention.

FIG. 2A is an exemplary schematic illustration of a vessel 100 for mitigating an implosion load, according to an embodiment of the invention. FIG. 2A shows the vessel 100 having energy absorbing structures 210, 220, 230, and 240 positioned throughout the vessel 100. As shown, the energy absorbing structures 210, 220, 230, and 240 as shown are located in the middle portion 130 and the second end portion 120. According to the present embodiment, portions 120 and 130 are structurally stronger than the end portion 110, which is designed to fail before portions 120 and 130. The energy absorbing structures 210, 220, 230, and 240 are therefore positioned within portions 120 and 130 in order to further dissipate energy and reduce surging pressure waves in portions 120 and 130, after end portion 110 succumbs to an overmatching load. An overmatching load may be a hydrostatic pressure load, an impact load, or an underwater explosion load for example, or combinations thereof. The surrounding water then enters the vessel 100 via the failed end portion 110 (shown as a dashed line) and flows generally in direction X towards end portion 120. It should be noted that FIG. 2A shows a vessel 100 having a dome-shaped end portions 110 and 120, and a cylindrical middle portion 130. However, as outlined above, one or both end portions 110 and 120 may have a shape other than the dome illustrated, such as for example, a conical shape, a toriconical shape, or a flat shape. The middle portion 130 may also have shapes other than cylindrical, such as frustroconical for example.

The energy absorbing structure 210 shown in FIG. 2A may comprise the entire vessel frame 101 of the high resistance portions 120 and 130, segments of the vessel frame 101, or one or more layers of the frame 101. The energy absorbing structures 210 may be plastics or metals such as aluminum and the like for example, composites, and combinations thereof. The energy absorbing structure 210 may be a coated layer on the frame 101. According to an embodiment, the coated layer may be an explosive resistant coating (ERC), pumice, foams, or the like. When a predetermined fracture portion such as portion 110, fails under an overmatching load, the energy of the inflowing surrounding water is dissipated by the energy absorbing structure 210. The resulting pressure waves are also reduced.

According to an embodiment of the invention, the energy absorbing structure 220 is one or more impedance mismatched layers. The impedance mismatched layers 220 may be positioned at the frame 101 of the vessel 100. The impedance mismatched layers 220 may be located adjacent to the energy absorbing structure 210, which as outlined above, may be the entire frame 101 or portions thereof. FIG. 2A shows the impedance mismatched layers 220 located internally, but the layers may also be positioned externally. The impedance mismatched layers 220 may include sandwich structures, honeycomb structures, or the like. Alternatively, the impedance mismatched layers 220 may comprise the actual frame 101 of the vessel 100. In one embodiment, the impedance mismatched layers 220 may be formed by providing a coating on the frame 101. In impedance mismatched layers 220, the mismatch of impedance between the layers governs the degree of energy exchange. When a predetermined fracture portion such as portion 110 fails the impedance mismatched layers 220 tend to concentrate shock energy within the vessel 100 for longer periods, thereby inhibiting energy surges from exiting the vessel 100 and generally reducing energy transmission to the area surrounding the vessel.

According to an embodiment, the energy absorbing structure 230 is one or more volume reduction structures. The volume reduction structures 230 may be any desired structure that occupies space within the vessel 100. Volume reduction structures 230 may include structures that are provided within the vessel 100, solely for the purpose of reducing the volume within the vessel 100. Volume reduction structures may also include vessel structures such as a fuel tank, an electronics closet, and equipment. The volume reduction structures 230 may be any shape that disrupts the general water flow direction X, of inflowing water which results from the failure of a predetermined fracture portion such as portion 110. When the predetermined fracture portion fails under an overmatching load, the volume reduction structures 230 reduce the internal volume thereby reducing the potential energy of the system. The structures 230 also obstruct the flow, preventing the focusing of the inflowing water, restricting any momentum build up, and consequently reducing the kinetic energy.

As shown in FIG. 2A, the energy absorbing structure 240 is one or more partitioning structures, such as bulkhead walls and the like. The partitioning structures 240 may be positioned at different locations within the vessel 100, and may extend to produce two or more adjacent compartments. Each compartment may be airtight. The provision of bulkhead walls function to break up a larger implodable volume into more than one smaller implodable compartment. Upon the failure of a predetermined portion such as portion 110 by fracturing or buckling, each compartment implodes separately at a different time from other implodable compartments. This reduces the momentum and energy of the implosion due to the resulting turbulent flow associated with breaking through the bulkhead walls. Additionally, the flow is non-continuous and non-focused due to the separate implosion events. For example, in a vessel 100 having several transverse bulkheads, if each bulkhead withstands the initial overmatching load, but subsequently collapses as a consequence of the hydrostatic pressure, then the water jet formed by the initial inflowing of water will have stopped, and only restarts when the bulkhead wall of an adjacent compartment fails.

FIG. 2A also shows vanes 250 located throughout the vessel 100. The vanes 250 are positioned to redirect the flow of the inrushing water upon the collapse of end portion 110. The vanes may be used to prevent the focusing of the inflowing water by imparting turbulence and disrupting the flow of the inrushing water. The vanes 250 may be used to guide the flow directly onto energy absorbing structures. For example, the vanes may direct the flow onto impedance mismatched layers 220. Although FIG. 2A shows two vanes 250, the vessel 100 may include as many vanes as desired. FIG. 2A also shows a pressure regulator arrangement 260 for regulating the pressure within the vessel 100. The pressure regulator arrangement 260 is adjustable and may substantially match the pressure within the vessel 100 to about the surrounding hydrostatic pressure. The pressure regulator arrangement 260 may include one or more pressure generators 265 for generating the desired pressure. In embodiments having partitioning structures 240 and airtight compartments, each airtight compartment may include a pressure generator 265. By substantially reducing or eliminating the pressure gradient between the internal vessel pressure and the external hydrostatic pressure, the potential energy of the inflowing water is minimized upon the collapse of end portion 110.

Figure 2B:
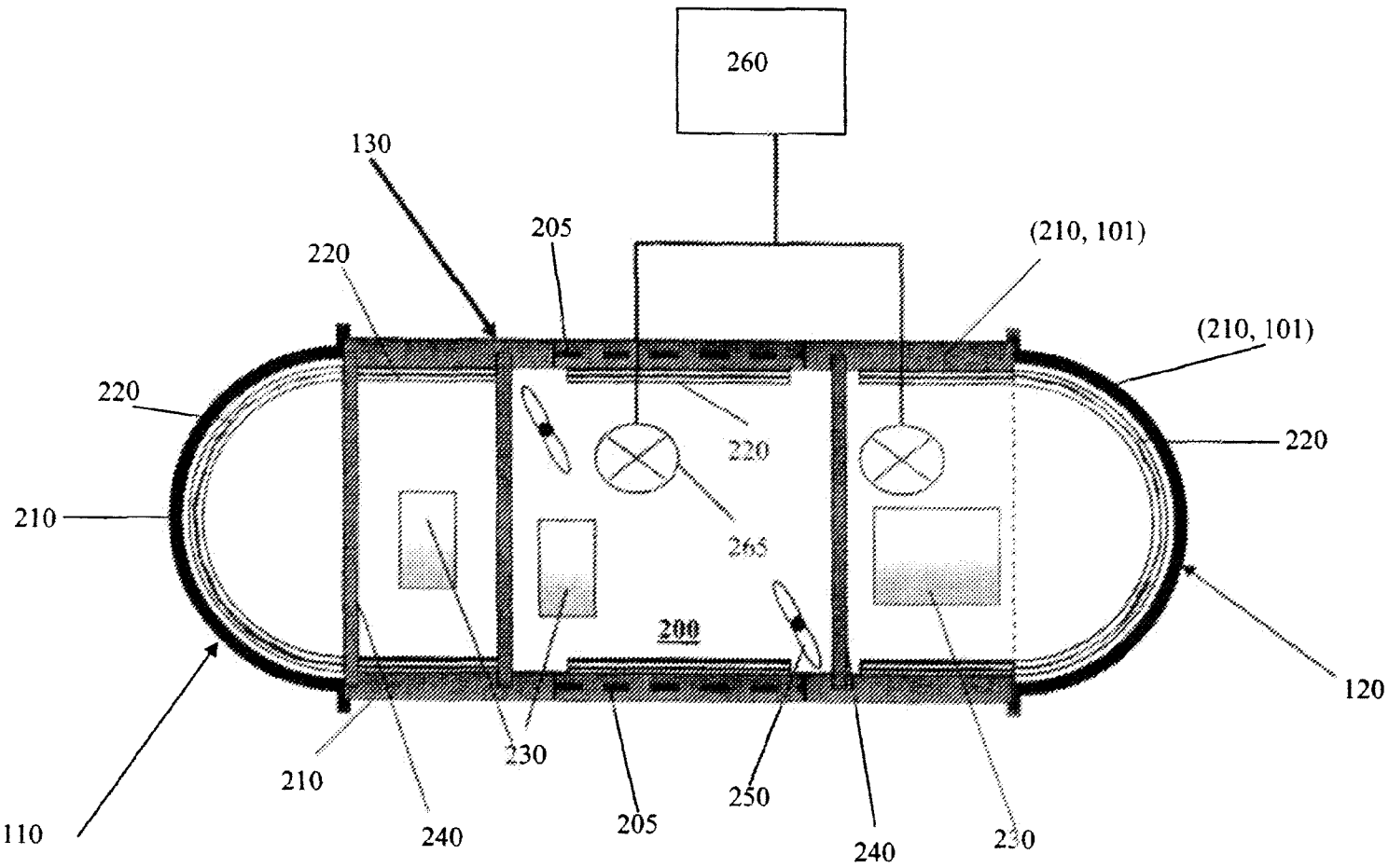
FIG. 2B is an exemplary schematic illustration of a vessel for mitigating an implosion load, according to an embodiment of the invention.

As stated above, a vessel may be structured to allow the middle portion 130 to collapse before the end portions 110 and 120. FIG. 2B is an exemplary schematic illustration of a vessel 200 for mitigating an implosion load, according to an embodiment of the invention. FIG. 2B illustrates the middle portion 130 being structurally weaker than the end portions 110 and 120, with the dotted lines 205 representing a structurally weaker portion. According to this embodiment, when the vessel 200 experiences an overmatching load, the middle portion 130 fails before the end portions 110 and 120. The numbering in FIG. 2B is similar to that of FIG. 2A, with like elements similarly represented. Although FIG. 2B shows a vessel 200 having dome-shaped end portions 110 and 120, and a cylindrical middle portion 130, as outlined above, one or both end portions 110 and 120 may have a shape other than the dome illustrated. For example, the end portions 110 may have a conical shape, a toriconical shape, or a flat shape. The middle portion 130 may also have shapes other than cylindrical, such as frustroconical for example.

As shown in FIG. 2B, the energy absorbing materials 210, 220, 230, and 240 outlined in the description of FIG. 2A, are positioned within the vessel 200 to mitigate the implosion load resulting from the failure of the middle portion 130. The vessel 200 also includes vanes 250 for directing the flow of the inrushing water. FIG. 2B also shows a pressure regulator arrangement 260 for regulating the pressure within the vessel 100. The pressure regulator arrangement 260 is adjustable and may substantially match the pressure within the vessel 200 to about the surrounding hydrostatic pressure. The pressure regulator arrangement 260 may include one or more pressure generators 265 for generating the desired pressure. Although FIG. 2B shows two vanes 250 and two pressure generators 265, the vessel 200 may include as many vanes 250 and pressure generators 265 as desired.

Figure 3:
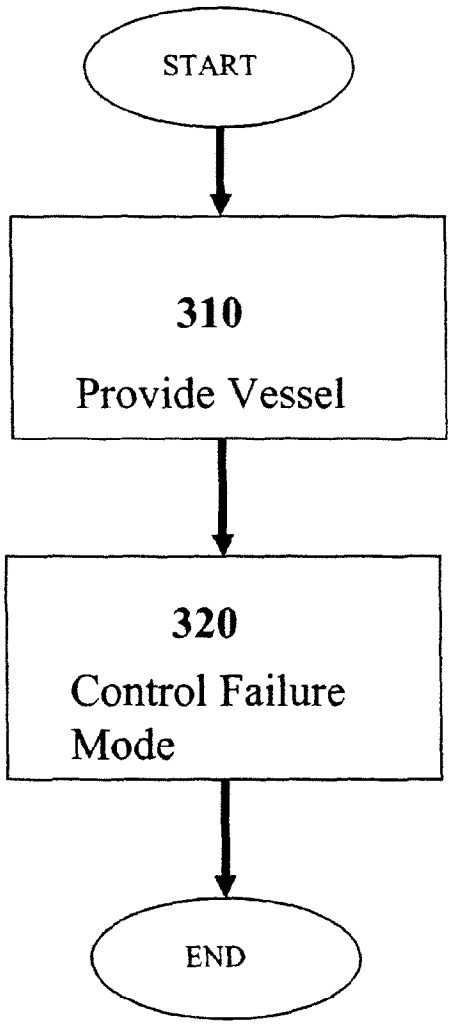
FIG. 3 is a method of mitigating an implosion load, according to an embodiment of the invention.

FIG. 3 is a flowchart illustrating a method 300 of implosion mitigation in a vessel. The method 300 is performed in an underwater environment in which an overmatching load exists. As outlined above, an overmatching load may be a hydrostatic pressure load, an impact load, or an underwater explosion load for example, or combinations thereof. The steps involved in the method 300 of implosion mitigation have been outlined above in detail in the description of FIGS. 1A-2B. Step 310 is the providing a vessel (100, 200). According to the method 300, the vessel (100, 200) as shown in FIGS. 1A, 2A, and 2B may include end portions 110 and 120, and a middle portion 130. The figures show the end portions 110 and 120 having dome shapes, and the middle portion 130 having a cylindrical shape. As stated above, the vessel (100, 200) may be any type of vessel typically employed in undersea environments, and thus depending on the application, the vessel (100, 200) may have a different shape. Thus, one or both end portions 110 and 120 may have a different shape such as for example, a conical shape, a toriconical shape, or a flat shape. The middle portion 130 may also have shapes other than cylindrical, such as frustroconical for example.

Step 320 is the controlling of the failure mode of the vessel by providing a predetermined fracture portion in the vessel, wherein the predetermined fracture portion fails under the overmatching load. When the predetermined fracture portion fails, the surrounding water enters the vessel primarily via the predetermined fracture portion. As outlined above with respect to the illustration of FIG. 2A, according to an embodiment of the invention, end portion 110 may be the predetermined fracture portion. Therefore when the portion 110 fails, the other portions 120 and 130 withstand the overmatching load. As outlined with respect to the illustration of FIG. 2B, when experiencing an overmatching load the middle portion 130 may be structured to fail before the end portions 110 and 120. When the middle portion 130 is a cylinder as shown, the cylinder may fail in an axisymmetric mode, asymmetric mode, multiwave mode, a general instability mode, or combinations of these modes. The number of circumferential lobes as for the general instability mode is a variable. In FIGS. 1B and 1C the reduced pressure and energy associated with a dome-first collapsed vessel model is compared to a cylinder-first collapsed vessel model.

The method 300 may also include the providing of the various implosion mitigation features illustrated in FIG. 2A. For example the method 300 may include providing the energy absorbing structures 210, 220, 230, and 240, as well as the vanes 250 and the pressure regulator arrangement 260. For example, the provision of partitioning structures 240, such as bulkhead walls function to break up a larger implodable volume into more than one smaller implodable compartments. As stated above, upon the failure of a predetermined portion such as portion 110, each compartment implodes separately at a different time from other implodable compartments. This reduces the momentum and energy of the implosion because of turbulent flow associated with breaking through new structures that separate the implodable compartments, as well as the non-continuous and non-focused flow caused by the separate implosion events. It should be noted that the features 210, 220, 230, 240, 250, and 260 may be superimposed on the vessel (100, 200) individually or combined, to mitigate an implosion load. Therefore in one embodiment, the vessel (100, 200) may include all features as shown in FIG. 2A. As outlined with respect to FIGS. 1A-1C, the vessel may not include any features shown in FIGS. 2A and 2B. Alternatively in another embodiment, the vessel (100, 200) may include only energy absorbing structures 210. In another example, the vessel (100, 200) may include impedance mismatched layers 220 and vanes 250.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. In an underwater environment at a depth at which the existing pressure load is an overmatching load, wherein the overmatching load comprises a hydrostatic load, an impact load, an explosion load, or combinations thereof, the method comprising:

providing a vessel having a frame; and controlling the failure mode of the vessel by providing a predetermined fracture portion of the vessel, wherein only the predetermined fracture portion fails at the overmatching load, thereby allowing surrounding water into the vessel primarily via the predetermined fracture portion;

the method further comprising;

pressurizing at least one compartment of the vessel to a pressure that substantially matches the external hydrostatic pressure to minimize the potential energy of the inflowing surrounding water when the predetermined fracture portion fails, so that energy and pressure transmission from the vessel to the surrounding area is minimized; and further providing one or more vanes within the vessel, so that when the predetermined fracture portion fails, the path of the inflowing surrounding water is redirected and disrupted to minimize the potential energy of the inflowing surrounding water, so that energy and pressure transmission from the vessel to the surrounding area is minimized.

2. The method of claim 1, further comprising:

providing energy absorbing structures at the vessel frame, so that when the predetermined fracture portion fails, energy and pressure transmission from the vessel to the surrounding area is reduced.

3. The method of claim 1, further comprising:

providing impedance mismatched layers at the vessel frame, so that when the predetermined fracture portion fails, energy releases within the vessel is contained, and energy and pressure transmission from the vessel to the surrounding area is reduced.

4. The method of claim 1, further comprising:

providing one or more partition walls within the vessel to provide a plurality of airtight compartments, so that when the predetermined fracture portion fails, the potential energy of the inflowing surrounding water is minimized, and the energy and pressure transmission from the vessel to the surrounding area is also minimized, and wherein the pressurizing of the at least one compartment of the vessel is performed by providing a pressure generator in each airtight compartment so that when the redetermined fracture portion fails, the energy and pressure transmission from the vessel to the surrounding area is minimized.

5. The method of claim 1, further comprising:

providing volume reduction objects within the vessel, so that when the predetermined fracture portion fails the potential energy of the inflowing surrounding water is minimized, so that energy and pressure transmission from the vessel to the surrounding area is also minimized.

6. In an underwater environment at a depth at which the existing pressure load is an overmatching load, wherein the overmatching load comprises a hydrostatic load, an impact load, an explosion load, or combinations thereof, the method comprising:

providing a vessel with a vessel frame, the vessel frame comprising, a first end portion, a second end portion, and a middle portion connecting the first end portion to the second end portion, wherein said first end portion is a predetermined fracture portion of the vessel, wherein only the predetermined fracture portion fails at the overmatching load, thereby allowing surrounding water into the vessel primarily via the predetermined fracture portion, the method further comprising;

pressurizing at least one compartment of the vessel to a pressure that substantially matches the external hydrostatic pressure to minimize the potential energy of the inflowing surrounding water when the predetermined fracture portion fails, so that energy and pressure transmission from the vessel to the surrounding area is also minimized; and providing one or more vanes within the vessel, so that when the redetermined fracture portion fails, the path of the inflowing water is redirected and disrupted to minimize the potential energy of the inflowing surrounding water, so that energy and pressure transmission from the vessel to the surrounding area is minimized.

7. The method of claim 6, further comprising:

providing energy absorbing materials at the vessel frame, so that when the predetermined fracture portion fails, energy and pressure transmission from the vessel to the surrounding area is reduced;

providing impedance mismatched layers adjacent to the energy absorbing materials, so that when the predetermined fracture portion fails, energy releases within the vessel is contained and energy and pressure transmission from the vessel to the surrounding area is reduced;

providing one or more partition walls within the vessel, compartmentalizing the vessel so that when the predetermined fracture portion fails, the potential energy of the inflowing surrounding water is minimized, and the energy and pressure transmission from the vessel to the surrounding area is also minimized; and providing volume reduction objects within the vessel, so that when the predetermined fracture portion fails the potential energy of the inflowing surrounding water is minimized, so that energy and pressure transmission from the vessel to the surrounding area is also minimized.

8. In an underwater environment at a depth at which the existing pressure load is an overmatching load, wherein the overmatching load comprises a hydrostatic load, an impact load, an explosion load, or combinations thereof, the method comprising:

providing a vessel with a vessel frame the vessel frame comprising, a first end portion, a second end portion, and a middle portion connecting the first end portion to the second end portion, wherein said middle portion is a predetermined fracture portion of the vessel wherein only the predetermined fracture portion fails at the overmatching load, thereby allowing surrounding water into the vessel primarily via the predetermined fracture portion, the method further comprising;

pressurizing at least one compartment of the vessel to a pressure that substantially matches the external hydrostatic pressure to minimize the potential energy of the inflowing surrounding water when the predetermined fracture portion fails, so that energy and pressure transmission from the vessel to the surrounding area is also minimized; and providing one or more vanes within the vessel, so that when the predetermined fracture portion fails, the path of the inflowing surrounding water is redirected and disrupted to minimize the potential energy of the inflowing surrounding water, so that energy and pressure transmission from the vessel to the surrounding area is minimized.

9. The method of claim 8, further comprising:

providing energy absorbing materials at the vessel frame, so that when the predetermined fracture portion fails, energy and pressure transmission from the vessel to the surrounding area is reduced;

providing impedance mismatched layers adjacent to the energy absorbing materials, so that when the predetermined fracture portion fails, energy releases within the vessel is contained and energy and pressure transmission from the vessel to the surrounding area is reduced;

providing one or more partition walls within the vessel, compartmentalizing the vessel so that when the predetermined fracture portion fails, the potential energy of the inflowing surrounding water is minimized, and the energy and pressure transmission from the vessel to the surrounding area is also minimized; and providing volume reduction objects within the vessel, so that when the predetermined fracture portion fails the potential energy of the inflowing surrounding water is minimized, so that energy and pressure transmission from the vessel to the surrounding area is also minimized.

* * * * *